US007681877B2

(12) United States Patent
Won

(10) Patent No.: US 7,681,877 B2
(45) Date of Patent: Mar. 23, 2010

(54) PAPER SUPPLY APPARATUS WITH BRAKE LEVER CONTROLLED LIFTER FOR A PRINTING DEVICE

(75) Inventor: Jung-yun Won, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/971,336

(22) Filed: Jan. 9, 2008

(65) Prior Publication Data

US 2008/0309004 A1 Dec. 18, 2008

(30) Foreign Application Priority Data

Jun. 15, 2007 (KR) ..... 10-2007-0059125

(51) Int. Cl.
*B65H 1/08* (2006.01)

(52) U.S. Cl. ..... 271/127; 271/117; 271/157

(58) Field of Classification Search ..... 271/117, 271/127, 157
See application file for complete search history.

(56) References Cited

U.S. PATENT DOCUMENTS 5,228,676 A * 7/1993 Arai et al. ..... 271/117
6,783,126 B2 8/2004 Amamoto

FOREIGN PATENT DOCUMENTS

JP 61075743 A * 4/1986
JP 04-41341 2/1992

* cited by examiner

*Primary Examiner*—Patrick H Mackey
*Assistant Examiner*—Gerald W McClain
(74) *Attorney, Agent, or Firm*—Stanzione & Kim LLP

(57) ABSTRACT

An image forming device includes a paper supply apparatus including an adjustable knock-up plate to store a plurality of papers and having a lifter, a pick-up roller and feed roller to pick up each of the plurality of papers and feed each of the plurality of papers into the image forming device respectively, a motor to drive a plurality of units in the image forming device including the knock-up plate, and a brake unit to selectively transmit and disconnect power to the lifter. The lifting operation of the knock-up plate, to smoothly supply papers to the image forming device, is performed by receiving power from an existing arbitrary motor installed within the image forming device, and not from an exclusive motor that is solely used to drive and lift the knock-up plate.

18 Claims, 4 Drawing Sheets

PAPER SUPPLY APPARATUS WITH BRAKE LEVER CONTROLLED LIFTER FOR A PRINTING DEVICE

CROSS-REFERENCE TO RELATED APPLICATIONS

This application claims the benefit under 35 U.S.C. § 119 (a) of Korean Patent Application No. 10-2007-0059125, filed on Jun. 15, 2007, in the Korean Intellectual Property Office, the disclosure of which is incorporated herein by reference in its entirety.

BACKGROUND OF THE INVENTION

1. Field of the Invention

The present general inventive concept relates to a paper supplying apparatus for a printing device such as printers or copiers.

2. Description of the Related Art

Generally, conventional printing devices such as printers or copiers include a conventional paper supply apparatus for supplying a sheet of paper stored in a cassette to a printing device by picking up sheets of paper one by one from a stack of papers P. As depicted in FIG. 1, a structure of the conventional paper supply apparatus that is widely used is one in which a knock-up plate 11 of a cassette where papers P are stacked is lifted by a lifter 12 so that a front-end of the uppermost sheet paper P can easily contact with a pick-up roller 13. If the stack height of the papers P is reduced as the papers P are fed into the printing device beyond a predetermined point, a motor 20 rotates the lifter 12 to lift the knock-up plate 11, and as a result, the front-end of the uppermost sheet of paper P is lifted to readily contact with the pick-up roller 13. A feeding roller 14, together with the pick-up roller 13, then pushes the sheet of paper P into the printing device.

However, in the structure of the conventional paper supply apparatus, the motor 20 is exclusively used to lift the knock-up plate 11 and must be installed separately. Therefore, the number of parts is increased, and the conventional paper supply apparatus becomes complicated. Additionally, due to the increase in the number of parts with the conventional paper supply apparatus, power consumption increases. Therefore, there is a need to develop a structure in which the paper P can be smoothly supplied to the printing device without the individual motor 20 that is exclusively used to lift the knock-up plate 11.

SUMMARY OF THE INVENTION

To solve the above and/or other problems, the present general inventive concept provides a paper supply apparatus in which a lifting operation of a knock-up plate, to smoothly supply papers to a printing device, is performed by receiving power from an existing arbitrary motor installed within the printing device, and not from an exclusive motor that is solely used to drive and lift the knock-up plate.

Additional aspects and utilities of the present general inventive concept will be set forth in part in the description which follows and, in part, will be obvious from the description, or may be learned by practice of the general inventive concept.

According to the foregoing aspects and/or utilities of the present general inventive concept, there is provided a paper supply apparatus for a printing device including a knock-up plate on which papers are stacked, a pick-up roller that feeds the papers into printing device by picking up the papers stacked on the knock-up plate, a lifter that lifts the knock-up plate so that the papers stacked on the knock-up plate contact with the pick-up roller, a motor for driving apparatuses in the printing device, a spring clutch that connects the motor to the lifter to transmit power, and a brake lever that selectively transmits power according to height variations of the pick-up roller via the spring clutch.

The spring clutch may comprise a first member connected to the motor, a second member connected to the lifter, a third member installed between the first and second members, and a coil spring whose both ends respectively are connected to the second and third members and which transmits a rotational force to the second and third members by rotating in a tightening direction due to friction when the first member rotates, wherein the brake lever blocks the transmission of power to the lifter via the second member by selectively stopping the rotation of the third member.

The pick-up roller may be biased towards the knock-up plate so as to be gradually lowered during the feeding of the papers, and the brake lever may be positioned at a location to block the rotation of the third member when the pick-up roller is lifted. When the pick-up roller is lowered, the brake lever may be rotated to a location to unlock the rotation of the third member.

According to the foregoing aspects and/or utilities of the present general inventive concept, there is also provided an image forming apparatus including an image forming unit to form an image on a printing medium, and a paper supply apparatus to feed the printing medium to the image forming unit. The paper supply apparatus may include a knock-up plate on which a plurality of printing media are stacked, a pick-up roller that feeds the papers into the image forming unit by picking up the printing media stacked on the knock-up plate, a lifter to lift the knock-up plate so that the printing media stacked on the knock-up plate contacts with the pick-up roller, a motor to drive apparatuses in the image forming apparatus, a spring clutch to connect the motor to the lifter to transmit power, and a brake lever to selectively transmit power to the lifter according to height variations of the pick-up roller via the spring clutch. The image forming apparatus of claim 4, wherein the spring clutch and the brake lever cooperate to selectively transmit power to the lifter according to height variations of the pick-up roller.

The spring clutch may further include a first member to receive power from the motor, a second member that transmits power received from the motor to the lifter, and a third member having a coil formed around the circumference thereof. The coil has a first end coupled to the second member and is rotated in a tightening direction around the third member.

The third member may further include a plurality of stoppers formed around the circumference thereof.

The brake lever is biased by a spring member so that a first end of the brake lever contacts a rotation bar that supports the pick up roller.

As the pick-up roller rotates downward due to the feeding of the print media into the image forming unit, a first end of the brake lever simultaneously rotates in a downward direction and accordingly an opposite end of the brake lever rotates in an upward direction.

When the opposite end of the brake lever rotates in an upward direction, the opposite end contacts the plurality of stoppers formed on the third member of the spring clutch to stop the rotation of the spring clutch.

According to the foregoing aspects and/or utilities of the present general inventive concept, there is also provided an image forming device having a paper supply apparatus including an adjustable knock-up plate to store a plurality of papers and having a lifter, a pick-up roller and feed roller to pick up each of the plurality of papers and feed each of the plurality of papers into the image forming device respectively, a motor to drive a plurality of units in the image forming device including the knock-up plate, and a brake lever to selectively transmit and disconnect power to the lifter.

The image forming device may further include a power transmitting device to selectively transmit power from the motor to an axis gear of the lifter.

The pick-up roller may be biased in a downward direction and continuously contacts a top sheet of the plurality of papers as the papers are fed into the printing device.

When the pick-up roller descends to a first predetermined height responsive to the plurality of papers being fed into the printing device, the power transmitting device transmits power from the motor to the axis gear of the lifter to elevate the knock-up plate. When the lifter elevates the knock-up plate to a second predetermined height, the power transmitting device disconnects power from the motor to the lifter accordingly.

The power transmitting device of the general inventive concept may be a spring clutch.

The spring clutch may include a first member that receives power from the motor, a second member that transmits power received from the motor to the lifter, a third member disposed between the first member and having a plurality of stoppers protruding therefrom, and a coil spring having a first end coupled to the second member and a second end coupled to the third member. When the first member receives power from the motor, the coil is rotated in a tightening direction around the first member and accordingly the second and third members rotate to transmit power to the lifter respectively.

The brake lever may further include a first end contacting the pick-up roller and a second end formed near the power transmitting device.

When the pick-up roller descends to the first predetermined height, the first end of the bake lever may also descend.

When the first end of the brake lever descends, the second end of the brake may also ascend and contact the plurality of stoppers of the third member of the spring clutch to inhibit the rotation of the spring clutch and interrupt the power transmission from the motor to the lifter.

According to the foregoing aspects and/or utilities of the present general inventive concept, there is also provided a paper cassette assembly of an image forming apparatus driven by an arbitrary motor of the image forming apparatus including a knock-up plate having a lifter to stack a plurality of papers and a spring clutch and brake lever communicating with each other to selectively transmit power from the motor to the lifter.

The paper cassette assembly may further include a pick-up roller to feed a plurality of papers into the image forming apparatus and have an edge contacting a first end of the brake lever.

The pick-up roller and the first end of the brake lever may simultaneously lower as the stack of papers reduce to a predetermined height responsive to the stack of papers being fed to the image forming apparatus.

The lifter may elevate the knock-up plate according to the predetermined height of the stack of papers.

When the knock-up plate elevates, the second end of the brake lever may contact with the spring clutch to prohibit the spring clutch from transmitting power to the lifter.

According to the foregoing aspects and/or utilities of the present general inventive concept, there is also provided an image forming apparatus including a paper supply apparatus having an adjustable knock-up plate to stack a plurality of printing media, a pick-up roller being formed to continuously contact an upper sheet of the printing media, and a brake lever to selectively control the height of the knock-up plate according to a position of the pick-up roller.

The knock up plate may be driven by a motor disposed in the image forming apparatus.

The brake lever may selectively control the height of the knock up plate by supplying power and inhibiting power transmitted from the motor to the knock up plate.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
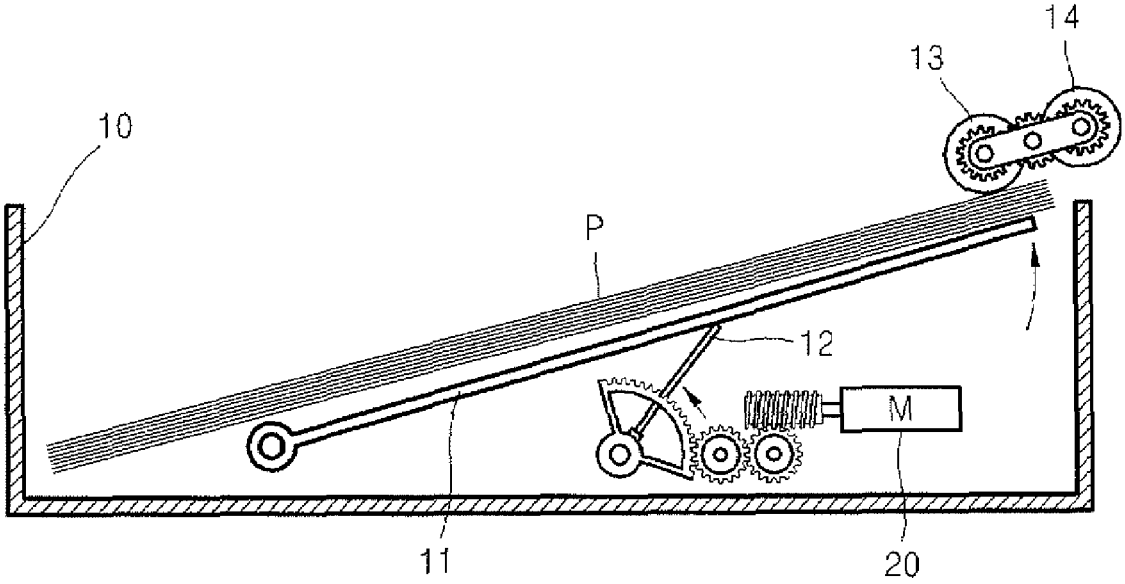
FIG. 1 (RELATED ART)
FIG. 1 is a cross-sectional view illustrating a conventional paper supply apparatus of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
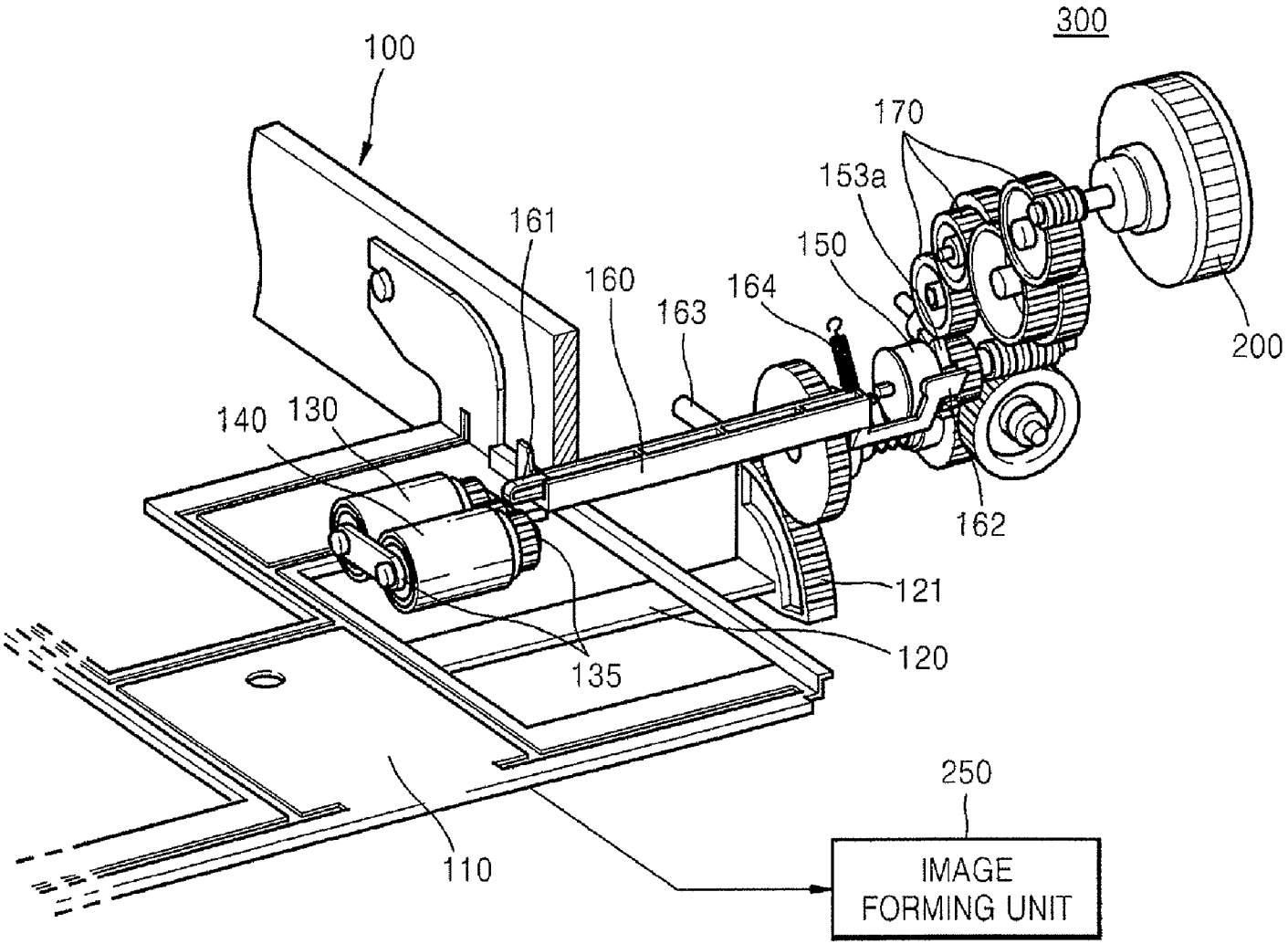
FIG. 2 is a view illustrating a paper supply apparatus of a printing device, according to an embodiment of the present general inventive concept.

FIG. 2 is a perspective view of a paper supply apparatus usable with an image forming apparatus 300 such as a printing device, according to an embodiment of the present general inventive concept. The image forming apparatus 300 may include the paper supply apparatus and an image forming unit 250 to form an image on a print medium supplied from the paper supply apparatus.

Referring to FIG. 2, the paper supply apparatus includes a knock-up plate 110 which is rotatably mounted in a paper cassette 100 and on which papers P are stacked, a lifter 120 that lifts the knock-up plate 110 so that the papers can easily contact with a pick-up roller 130, and a power transmitting device that selectively transmits power generated from a motor 200 to the lifter 120 to lift the knock-up plate 110 as necessary.

The motor 200 is not an exclusive motor that is solely used to elevate the lifter 120 as described above in the related art and shown in FIG. 1. Instead, the motor 200 may be adapted for multiple purposes, such as, for example, to drive a conventional development unit in the printing device as well as the lifer in the paper supply apparatus. In order for the motor 200 to drive multiple objects within the printing device, intermediate gears 170 that typically transmit power, are preferably disposed between the motor 200 and the lifter 120, since there is sufficient space and distance between the motor 200 and the lifter 120. Although not specifically shown in FIG. 2, as an example, power can be transmitted to multiple driving objects within the printing device such as the a development unit and the lifter 120 by connecting an additional gear to the intermediate gears 170 via a pulley assembly. Typically, the intermediate gears 170 and the additional gear would transmit a driving force which is generated from the motor 200 to both the development unit and the lifter 120, thereby eliminating the need for multiple motors; one to drive the development and one to exclusively drive the lifter 120.

A power transmitting device, which will be described in further detail below, is positioned near the motor 200 and the intermediate gears 170 to set up and interrupt the transmission of the driving force of the motor 200 to the lifter 120. In particular, the power transmitting device is structured to either automatically transmit power from the motor 200 to the lifter 120 or automatically disconnect power from the motor 200 to the lifter 120 according to height variations of the pick-up roller 130. In particular, as the height of the pick-up roller 130 descends to a first location as a result of the decrease in the stack height of papers P as they are fed to the printing device, the power transmitting device 300 transmits power accordingly from the motor 200 to the lifting device 120 to elevate the knock-up plate 110. Alternatively, as the height of the pick-up roller 130 ascends to a second location, due to the elevation of the knock-up plate 110, power is disconnected from the motor thereby interrupting power from the motor 200 to the lifting device 120. The embodiment as described above eliminates the need for an electronic control element, such as a solenoid to set up and interrupt the transmission of the driving force of the motor 200 which will be described in further detail below.

As shown in FIG. 2, the pick-up roller 130 is installed on a free-end of a rotation bar 135 that contacts an end 161 of a break lever 160 and is supported along an axis of the pick-up roller 130 and a feeding roller 140. The pick-up roller 130 is biased to drop down towards the knock-up plate 110 due to its weight. Thus, even if the stack height of the papers is gradually reduced due to the feeding of the papers P stacked on the knock-up plate 110 into the printing device, the weight of the pick-up roller 130 allows the pickup roller 130 to continually contact the uppermost paper P to some degree. However, if the stack height of the papers P is further reduced beyond some predetermined threshold whereby the pick-up roller 130 can no longer contiguously contact the uppermost paper due to the continuous feeding of the papers into the printing device, the stack height of the papers P is determined to be below the limit in which the pick-up roller 130 can smoothly pick-up a sheet of paper P to feed the paper P into the printing device. Therefore, in order to maintain a normal (i.e. smooth) paper pick-up operation by the pick-up roller 130, the knock-up plate 110 is gradually lifted by the lifter 120 so that the papers P may be smoothly fed into the printing device.

A power transmitting device such as a spring clutch 150 is used to selectively transmit the power from the motor 200 to the lifting device 120, in conjunction with the brake lever 160 which will be described further below. Specifically, the spring clutch 150 is connected to the motor 200 and installed among element members including the intermediate gears 170. The intermediate gears 170 transfer power from the motor 200 to an axis gear 121 of the lifter 120, thereby causing the lifter 120 to elevate. However, the spring clutch 150 functions to either enable or inhibit the transfer of power that the intermediate gears 170 receive from the motor and transmit to the axis gear 121 of the lifter 120, upon a determination that the lifter need or need not be lifted, as described above. Thus, the control of power transmission from the motor 200 to the axis gear 121 of the lifter 120 and disconnection of power from the motor 200 to the axis gear 121 of the lifter 120 is performed by the spring clutch 150.

Figure 4:
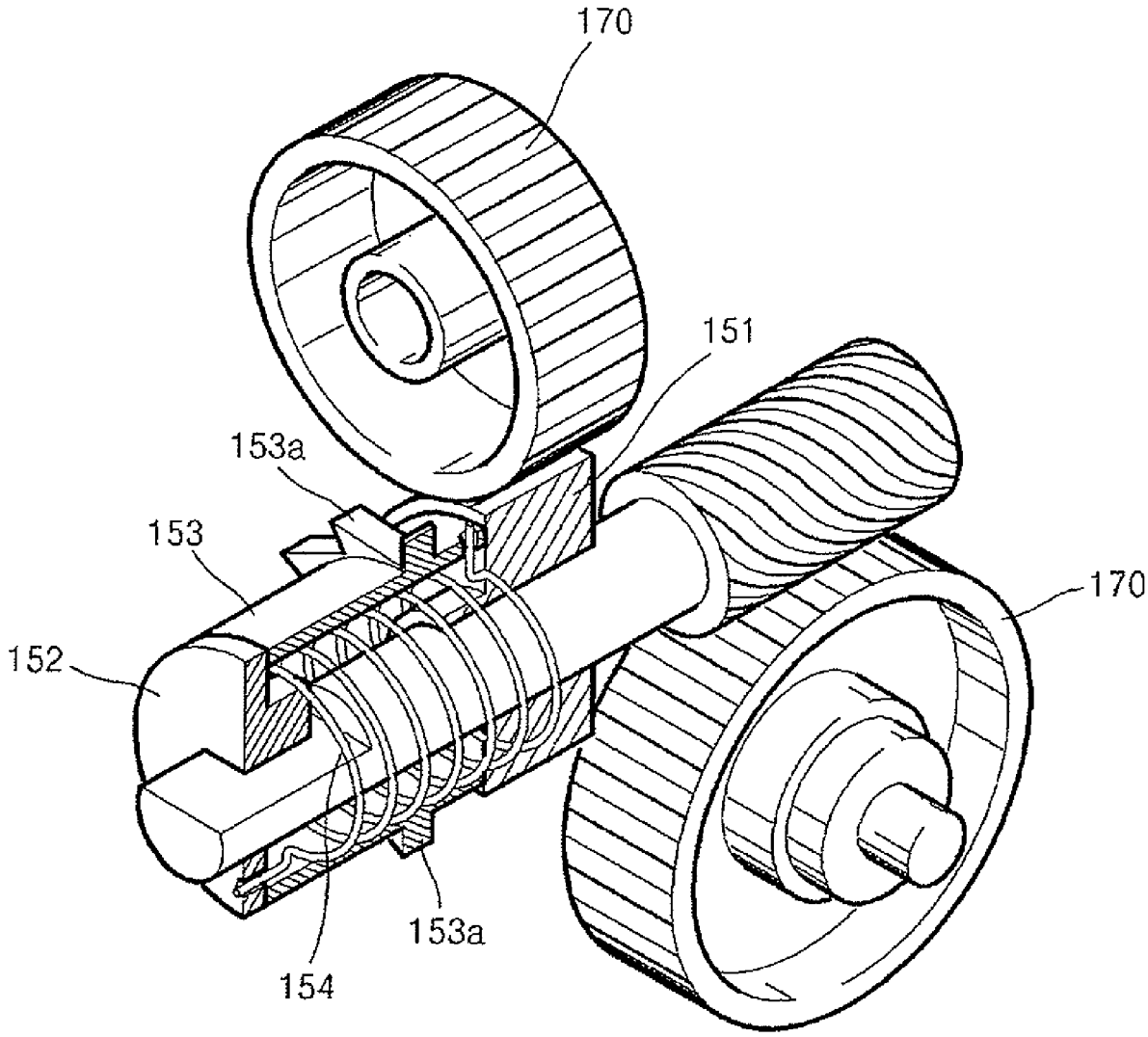
FIG. 4 is a view illustrating the structure of a spring clutch employed in the paper supply apparatus of FIG. 2, according to an embodiment of the present general inventive concept.

Referring to FIG. 4, the spring clutch 150 includes a first member 151 that receives power from the motor 200, a second member 152 that transmits the power from the motor 200 to the axis gear 121 of the lifter 120, a third member 153 installed between the first and second members 151 and 152, and a coil spring 154 having both ends respectively connected to the second member 152 and the third member 153 and a surface frictionally contacting with the first member 151. Thus, when the first member 151 receives power from the motor 200, and is rotated by the power of the motor 200 and accordingly, the coil spring 154 is rotated and wound in a tightening direction around the first member 151 (i.e. a direction that causes the coil to constrict around the outer periphery of the first member). Due to the friction of the coil spring 154 as it is constricted around the first member 151 and the second and third members 152 and 153 having both ends connected to the respective ends of the coil spring 154; the second and third members 153,152 also rotate thereby transmitting power to the axis gear 121 of the lifter 120.

Figure 3:
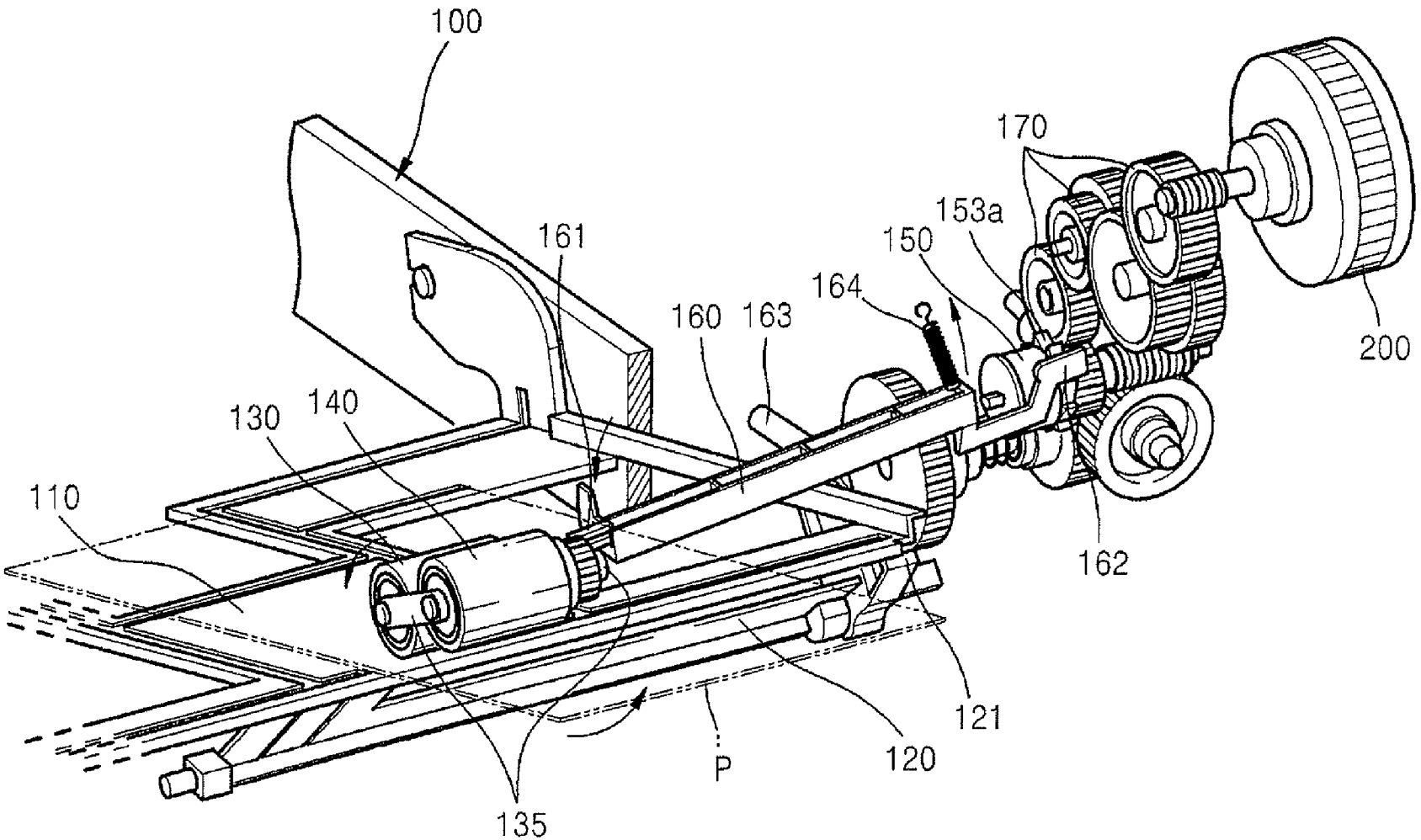
FIG. 3 is a view illustrating the paper supply apparatus of FIG. 2, in which a knock-up plate is lifted.

A plurality of stoppers 153*a* are formed on an external circumference of the third member 153 to disconnect power transmission from the motor 200 to the lifter 120 via the brake lever 160. In particular, an axis 163 of the brake lever 160 is rotatably supported by a predetermined frame (not shown) of the printing device, and the brake lever 160 is biased by a spring 164 so that the end 161 of the brake lever 160 can contact with the rotation bar 135 that supports the pick-up roller 130. As shown in FIG. 3, when the pick-up roller 130 is lowered due to the feeding of the paper into the printing device, the end 161 of the brake lever 160 is also lowered, and as a result, an opposite end 162 of the brake lever 160 is lifted. Alternatively, when the pick-up roller 130 is lifted again due to the lifting of the knock-up plate 110, the end 161 of the brake lever 160 rises and the opposite end 162 of the brake lever 160 is lowered. When the opposite end 162 of the brake lever 160 reaches a predetermined level, the opposite end 162 of the brake lever 160 is stopped by the stoppers 153*a* of the third member 153. By this arrangement, when the stoppers 153*a* of the third member 153 block or stop the opposite end 162 of the brake lever 160 from lowering further, the third member 153 is able to turns but cannot completely rotate due to the interference of the brake lever 160. Accordingly, the coil spring 154 cannot rotate since the third member 153 cannot rotate, and the second member 152 also cannot rotate, thereby disconnecting power transmission of the motor 200 from the lifter 120. At this point, slipping continually occurs at the friction surface between the first member 151 and the coil spring 154, since the third member 153 turns but does not completely rotate. Therefore, without using an electronic control element such as a solenoid, a mechanism to operate the knock-up plate 110 is realized that automatically transmits and disconnects power from the motor 200 to the lifter 120 according to the height variations of the pick-up roller 130 that rotates to feed the paper into the printing device.

Generally, the operation mechanism of the present general inventive concept can be summarized as follows.

Although the motor 200 drives other apparatuses in the printing device such as a developer, when printing begins, the motor 200 may also drive the paper supply apparatus, and when the printing is completed, the operation of the paper supply apparatus also stops. Therefore, starting and stopping of the motor 200 cannot be a problem. Thus, when printing begins, power of the motor 200 is transmitted to corresponding apparatuses such as the developer to drive the corresponding apparatuses and, at the same time, the power is transmitted to the lifter 120 to appropriately lift the knock-up plate 110. The power is selectively transmitted to the lifter 120 by mutual action between the brake lever 160 and the spring clutch 150. If sufficient paper is stacked on the knock-up plate 110, the opposite end 162 of the brake lever 160 is stopped by the stoppers 153*a* formed on the third member 153 of the spring clutch 150. Thus, the power of the motor 220 transmitted to the first member 151 of the spring clutch 150 cannot be transmitted to the axis gear 121 of the lifter 120 via the second member 152, that is, the lifter 120 does not move.

However, when the paper P is fed due to the continual pick-up of the paper, the pick-up roller 130 is gradually lowered together with the rotation bar 135. Accordingly, the end 161 of the brake lever 160 is lowered, and thus, as shown in FIG. 3, the opposite end 162 of the brake lever 160 is lifted. Thus, the stoppers 153*a* that block and inhibit the rotation of the third member 153 of the spring clutch 150 is released, and the rotational force of the first member 151 is transmitted to the second member 152 and the third member 153 via the coil spring 154. Accordingly, the power is transmitted to the axis gear 121 to rotate the lifter 120, thereby lifting the knock-up plate 110. Then, the pick-up roller 130 is pushed back to its original position, and the brake lever 160 also returns to its original position to block the rotation of the third member 153 of the spring clutch 150. In other words, the power of the motor 200 is transmitted to the axis gear 121 of the lifter 120 until the knock-up plate 110 is lifted to a predetermined height, and afterwards, the transmission of the power is disconnected until the lifting of the knock-up plate 110 is necessary again due to the feeding of paper into the printing device.

According to the above configuration, a smooth paper supply operation can be performed without using an exclusive motor for lifting the knock-up plate 110.

As described above, a paper supply apparatus for a printing device according to the present general inventive concept has many of the following advantages including but not limited to.

First, since a knock-up plate can be lifted using power of a motor that is used to drive other apparatuses of the printing device, an exclusive motor for the lifter of the paper supply apparatus r is unnecessary, thereby reducing the number of parts and power consumption.

Second, since the operation of a spring clutch is not performed using an electronic control element such as a solenoid, rather instead, is mechanically performed using a brake lever according to height variations of a pick-up roller, a malfunction problem due to an electrical signal error can be prevented.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming device having a paper supply apparatus comprising:

an adjustable knock-up plate to store a plurality of papers and having a lifter;

a pick-up roller and feed roller to pick up each of the plurality of papers and feed each of the plurality of papers into the image forming device respectively, the pick-up roller being biased in a downward direction and continuously contacts a top sheet of the plurality of papers as the papers are fed into the printing device;

a motor to drive a plurality of units in the image forming device including the knock-up plate; and a brake lever to selectively transmit and disconnect power to the lifter.

2. The image forming device of claim 1, further comprising:

a power transmitting device to selectively transmit power from the motor to an axis gear of the lifter.

3. The image forming device of claim 1, wherein when the pick-up roller descends to a first predetermined height responsive to the plurality of papers being fed into the printing device, the power transmitting device transmits power from the motor to the axis gear of the lifter to elevate the knock-up plate, when the lifter elevates the knock-up plate to a second predetermined height, the power transmitting device disconnects power from the motor to the lifter accordingly.

4. The image forming device of claim 3, wherein the power transmitting device comprises a spring clutch.

5. The image forming device of claim 4, wherein the spring clutch comprises:

a first member that receives power from the motor;

a second member that transmits power received from the motor to the lifter;

a third member disposed between the first member and having a plurality of stoppers protruding therefrom; and a coil spring having a first end coupled to the second member and a second end coupled to the third member, wherein when the first member receives power from the motor, the coil is rotated in a tightening direction around the third member and accordingly the second and third members rotate to transmit power to the lifter respectively.

6. The image forming device of claim 5, wherein the brake lever further comprises a first end contacting the pick-up roller and a second end formed near the power transmitting device.

7. The image forming device of claim 6, wherein when the pick-up roller descends to the first predetermined height, the first end of the bake lever also descends.

8. The image forming device of claim 7, wherein when the first end of the brake lever descends, the second end of the brake ascends and contacts the plurality of stoppers of the third member of the spring clutch to inhibit the rotation of the spring clutch and interrupt the power transmission from the motor to the lifter.

9. A paper supply apparatus for a printing device, comprising:

a knock-up plate on which a plurality of papers are stacked;

a pick-up roller that feeds the papers into the printing device by picking up the papers stacked on the knock-up plate;

a lifter to lift the knock-up plate so that the papers stacked on the knock-up plate contact with the pick-up roller;

a motor to drive apparatuses in the printing device;

a spring clutch to connect the motor to the lifter to transmit power; and a brake lever to selectively transmit power to the lifter according to height variations of the pick-up roller via the spring clutch.

10. The paper supply apparatus of claim 9, wherein the spring clutch comprises:

a first member connected to the motor;

a second member connected to the lifter;

a third member installed between the first and second members; and a coil spring having two ends that respectively connect to the second and third members and which transmit a rotation force to the second and third members by rotating in a tightening direction due to friction when the first member rotates, wherein the brake lever blocks the transmission of power to the lifter via the second member by selectively stopping the rotation of the third member.

11. The paper supply apparatus of claim 10, wherein:

the pick-up roller is biased towards the knock-up plate so as to be gradually lowered during the feeding of the papers, and the brake lever is positioned at a location to block the rotation of the third member when the pick-up roller is lifted, however, when the pick-up roller is lowered, the brake lever is rotated to a location to unblock the rotation of the third member.

12. An image forming apparatus comprising:

an image forming unit to form an image on a printing medium; and a paper supply apparatus to feed the printing medium to the image forming unit comprising:

a knock-up plate on which a plurality of printing media are stacked;

a pick-up roller that feeds the papers into the image forming unit by picking up the printing media stacked on the knock-up plate;

a lifter to lift the knock-up plate so that the printing media stacked on the knock-up plate contacts with the pick-up roller;

a motor to drive apparatuses in the image forming apparatus;

a spring clutch to connect the motor to the lifter to transmit power; and a brake lever to selectively transmit power to the lifter according to height variations of the pick-up roller via the spring clutch.

13. The image forming apparatus of claim 12, wherein the spring clutch and the brake lever cooperate to selectively transmit power to the lifter according to height variations of the pick-up roller.

14. The image forming apparatus of claim 12, wherein the spring clutch further comprises:

a first member to receive power from the motor;

a second member that transmits power received from the motor to the lifter; and a third member having a coil formed around the circumference thereof, wherein the coil has a first end coupled to the second member and is rotated in a tightening direction around the third member.

15. The image forming apparatus of claim 14, wherein the third member further includes a plurality of stoppers formed around the circumference thereof.

16. The image forming apparatus of claim 12 wherein the brake lever is biased by a spring member so that a first end of the brake lever contacts a rotation bar that supports the pick up roller.

17. The image forming apparatus of claim 12, wherein as the pick-up roller rotates downward due to the feeding of the print media into the image forming unit, a first end of the brake lever simultaneously rotates in a downward direction and accordingly an opposite end of the brake lever rotates in an upward direction.

18. The image forming apparatus of claim 17, wherein when the opposite end of the brake lever rotates in an upward direction, the opposite end contacts the plurality of stoppers formed on the third member of the spring clutch to stop the rotation of the spring clutch.

* * * * *